US008567627B2

(12) United States Patent
Schmider

(10) Patent No.: US 8,567,627 B2
(45) Date of Patent: Oct. 29, 2013

(54) SMALL CONTAINER FOR LIQUID AND/OR PASTY MATERIALS AND A METHOD OF PRODUCING THE SAME

(75) Inventor: Klaus Schmider, Hausach (DE)

(73) Assignee: Ucon AG Containersysteme KG, Hausach (DE)

( * ) Notice: Subject to any disclaimer, the term of this patent is extended or adjusted under 35 U.S.C. 154(b) by 881 days.

(21) Appl. No.: 12/620,290

(22) Filed: Nov. 17, 2009

(65) Prior Publication Data

US 2010/0126989 A1 May 27, 2010

(30) Foreign Application Priority Data

Nov. 18, 2008 (DE) ..... 20 2008 015 293 U

(51) Int. Cl.
*B65D 6/00* (2006.01)

(52) U.S. Cl.
USPC ..... 220/4.12; 220/254.8; 206/509; 206/598; 72/347; 222/160; 222/166; 222/185.1

(58) Field of Classification Search
USPC ..... 220/4.12, 254.8; 206/509, 598; 222/166, 185.1, 160; 72/347
See application file for complete search history.

(56) References Cited

U.S. PATENT DOCUMENTS

| | | | | |
|---|---|---|---|---|
| 4,847,028 | A * | 7/1989 | Snyder et al. | 264/155 |
| 5,702,034 | A * | 12/1997 | Semenenko | 222/143 |
| 6,079,587 | A * | 6/2000 | Vogt | 220/571 |

FOREIGN PATENT DOCUMENTS

| | | |
|---|---|---|
| DE | 297 13 725 | 11/1997 |
| DE | 200 13 000 | 11/2000 |
| EP | 1719714 A1 | 11/2006 |
| GB | 1541141 | 7/1975 |

OTHER PUBLICATIONS

Austrian Pat. Appln. No. GM 058/2009 filed Feb. 4 2009, Search Report, 6 pages (English translation).

* cited by examiner

*Primary Examiner* — Anthony Stashick
*Assistant Examiner* — Elizabeth Volz
(74) *Attorney, Agent, or Firm* — Andrew F. Young, Esq.; Lackenbach Siegel, LLP

(57) ABSTRACT

The invention is a small container for storing and discharging liquid and/or pasty materials. The container has a cylindrical tank with a cleaning portal mounted in the top-most portion thereof, and a base further comprising a discharge hopper. The base is configured with a wedge shape and is manufactured from material capable of being deep-drawn. The base is produced in one piece with the discharge hopper. The discharge hopper is shaped jointly with the base by means of a cupping procedure and is sloped at an angle of approximately 12°. An upper area of the base is molded with a first stroke of the cupping procedure and the drainage hopper, as an eccentric drainage cup, is molded with a second stroke. The container can have a stacking support assembly mounted on an upper portion of the container, and a stacking acceptance assembly mounted on a lower portion of the container.

17 Claims, 5 Drawing Sheets

SMALL CONTAINER FOR LIQUID AND/OR PASTY MATERIALS AND A METHOD OF PRODUCING THE SAME

CROSS REFERENCE TO RELATED APPLICATIONS

This application is related to, and claims priority from, German Patent Application Serial No. 20 2008 015 293.3, filed Nov. 18, 2008, the entire contents of which is incorporated herein by reference.

BACKGROUND OF THE INVENTION

1. Field of the Invention

The present invention relates to a small container for liquid and/or pasty materials, especially foodstuffs, having a cylindrical tank and a base, with the base having a discharge hopper. More specifically, the present invention relates to a small container having a cylindrical tank and a base, with the base having a discharge hopper and wherein the discharge hopper is drawn eccentrically as a discharge cup in the wedge-shaped base.

2. Description of the Related Art

The related art discloses small containers, for example, in German Patent No. DE 200 13 000 U1, or in German Patent No. DE 297 13 725 U1. These disclosures have a cylindrical tank which is often placed in a rack with a standardized ground-plan. They are suitable for collection, transportation and intermediate storage of hazardous liquids, for example, or foodstuffs. Customarily the containers consist of metallic material, preferably high-grade steel.

FIG. 6 is a perspective drawing of a small container 10 according to prior art. Among other features, small container 10 has a cylindrical tank 20 and a wedge-shaped base 30. Originating at the lowest point of base 30 a discharge hopper 40 is configured to one side of tank 20. A floor of discharge hopper 40 is configured to slant from the lowest point of wedge-shaped base 30 to a drainage opening 60, so that finally draining opening 60 represents the lowest point of tank 20.

FIGS. 7 and 8 depict side views of wedge-shaped base 30 as per FIG. 6 with discharge hopper 40 welded on. Proceeding from cylindrical tank 20, the base walls of base 30 descend in wedge fashion to a wedge tip 34 which represents the lowest point of wedge-shaped base 30. The wedge tip is located in an area in which a central axis A of tank 20 goes through base 30. The drainage hopper 40 starts in this latter area, and is welded onto wedge-shaped base 30.

Also, the view from below of base 30 and discharge hopper 40 in FIG. 9 makes clear the arrangement of discharge hopper 40 on known bases of small containers.

At its lowest point, which at the same time is the lowest point of the entire small container 10, discharge hopper 40 has a drainage opening 60. Thus, in discharge hopper 40, a slight slope 42 is formed toward drainage opening 60 from the area of wedge tip 34 to drainage opening 60. The slope 42 has been selected with a sloping angle $\alpha$ of about 2°.

Discharge hopper 40 itself, is also configured to be wedge-shaped. It extends from an upper section of base 40 downward in the direction of drainage opening 60 and laterally to wedge tip 34 of base 40. In the upper area, base 30 has its wedge base 32. The side walls 44 of discharge hopper 40 descend to drainage opening 60 considerably more steeply than base 30 from wedge base 32 downward to wedge tip 34. Base 30 drops with a base angle $\beta$ of about 26°.

Discharge hopper 40 is connected by a welded seam 46 with base 30.

What is not appreciated by the prior art is the manufacturing process associated with base 30, because discharge hopper 40 must be aligned as exactly as possible before welded seam 46 can be applied. Secondly, in the area of welded seam 46, especially in the interior of small container 10, an untidy surface is produced. Consequently, welded seam 46 has to be carefully polished in an inner area. Even if welded seam 46 is carefully polished, often impurities nonetheless collect in this area. In addition, in the area of welded seam 46, increased corrosion can result.

Accordingly, there is a need for an improved small container having a base produced in a more cost-effective manner and configured so as to be more cleaning-friendly.

OBJECTS AND SUMMARY OF THE INVENTION

One aspect of the present invention is to eliminate the disadvantages of known small containers. The base of such a small container should be produced in a more cost-effective manner and be configured so as to be more cleaning-friendly.

The essential novelty of the invention-specific small container is that the base is produced as a single piece with the discharge hopper. The base can, for example, be manufactured as a single piece by a cupping process with at least one stroke. It is advantageous to use a cupping process with two strokes for manufacturing invention-specific bases. In a first stroke, a symmetrical, upper area of the base is drawn. In a second stroke the discharge hopper is drawn.

The present invention relates to a small container for storing and discharging liquid and/or pasty materials, and the method for manufacturing the same. The container has a cylindrical tank with a cleaning portal mounted in the topmost portion thereof, and a base further comprising a discharge hopper. The base is configured with a wedge shape and is manufactured from material capable of being deep-drawn. The base is produced in one piece with the discharge hopper. The discharge hopper is shaped jointly with the base by means of a cupping procedure and is sloped at an angle of approximately 12°. An upper area of the base is molded with a first stroke of the cupping procedure and the drainage hopper, as an eccentric drainage cup, is molded with a second stroke. The container can have a stacking support assembly mounted on an upper portion of the container, and a stacking acceptance assembly mounted on a lower portion of the container.

In an advantageous embodiment form of the invention-specific small container, the discharge hopper is drawn eccentrically as a discharge cup in the wedge-shaped base. This can be achieved with the second stroke of the above-described advantageous cupping process. With the cupping process, attention is especially given to the wall thickness of the base in a version with two strokes.

As compared to known smaller containers, with the invention-specific small containers, the welded seam between the discharge hopper and the base is removed. Without the welded seam, the base is better cleaned. The manufacturing process is markedly simplified, because welding and subsequent polishing of the welded seam are dispensed with.

The one-piece form of the base permits better drainage. Forms favorable for flowing can be configured as desired, without consideration needing to be taken to boundary conditions from welding technology. In addition, material, along with energy costs, can be saved, and the labor time required for the manufacture can be lowered.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
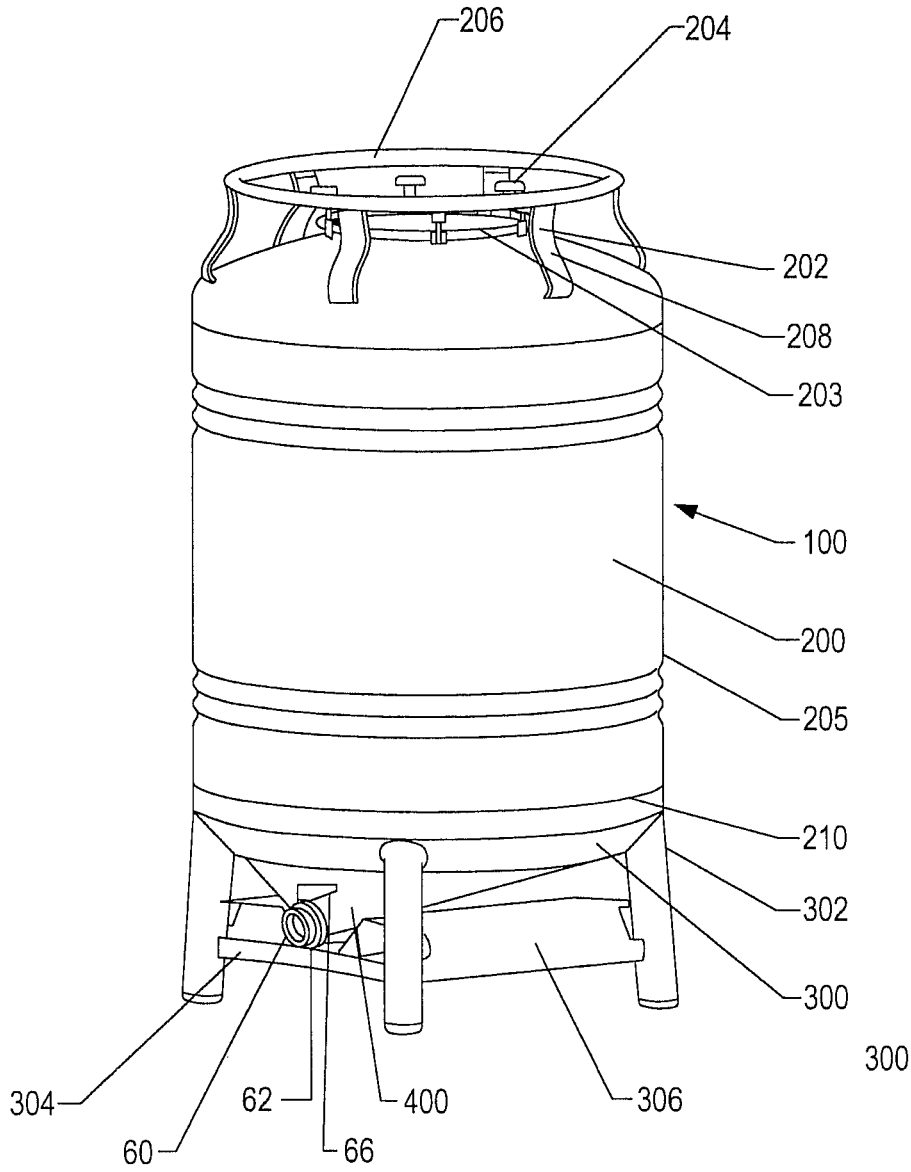
FIG. 1 is a perspective view of a small container of the present invention.

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, and below may be used with respect to the drawings. These and similar directional terms should not be construed to limit the scope of the invention in any manner. The words "connect," "couple," and similar terms with their inflectional morphemes do not necessarily denote direct and immediate connections, but also include connections through mediate elements or devices.

Figure 6:
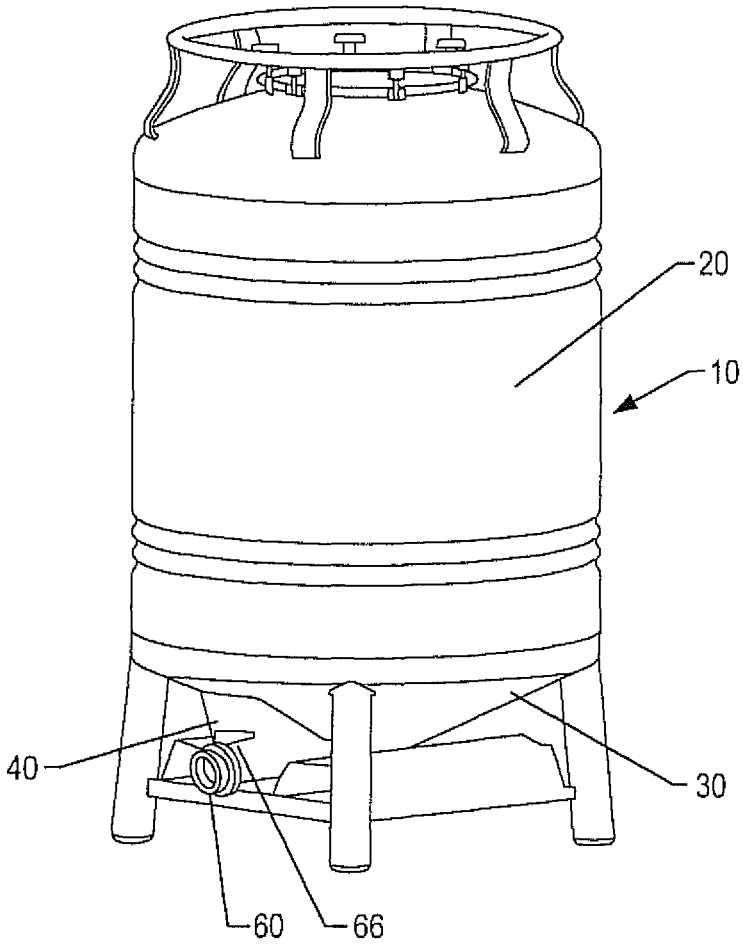
FIG. 6 PRIOR ART
FIG. 6 is a perspective depiction of a known small container.
Figure 7:
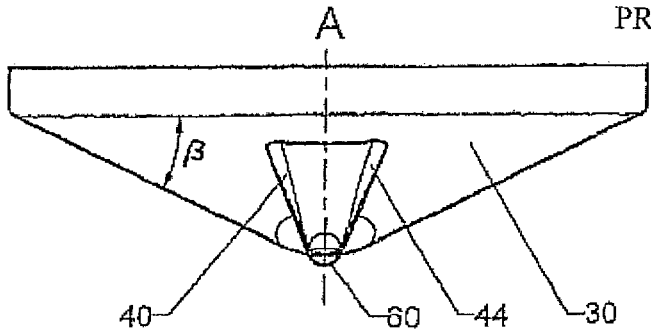
Figure 7 PRIOR ART
FIG. 7 is a first side view of the base of the known small container as is shown in FIG. 6.
Figure 8:
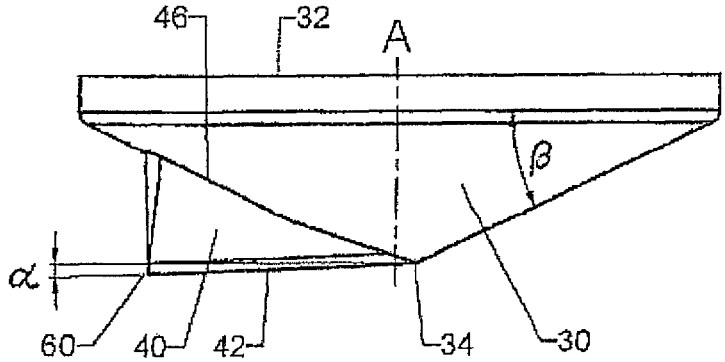
Figure 8 PRIOR ART
FIG. 8 is a second side view of the base of the known small container of FIG. 7 after being turned by 90° about the central axis.
Figure 9:
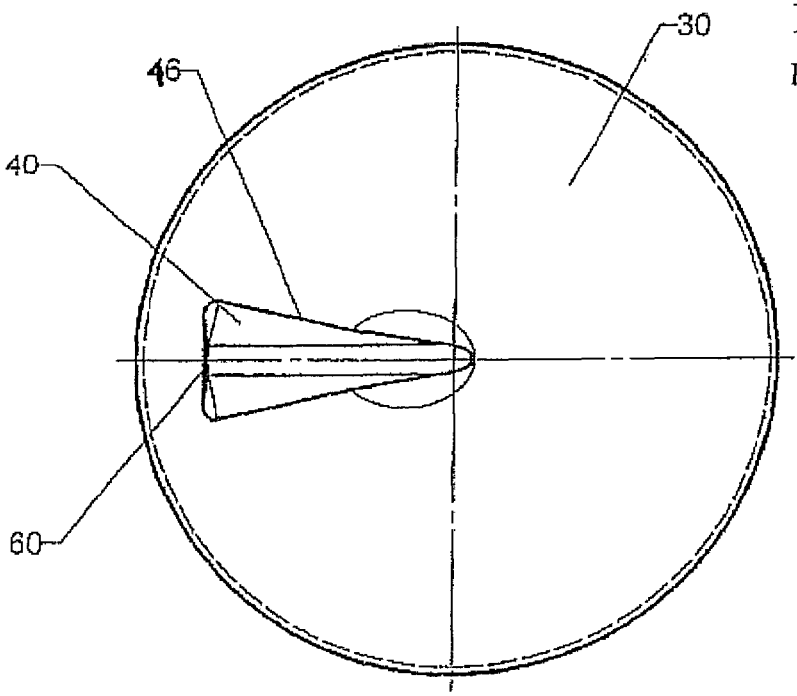
Figure 9 PRIOR ART
FIG. 9 is a bottom view of the base of the known small container of FIG. 7.

FIG. 1 shows an invention-specific small container 100 for foodstuffs with a cylindrical tank 200 and a base 300. The invention-specific small container 100 corresponds to a large extent to known small container 10 from FIG. 6. One exception is the base 300 of invention-specific small container 100. Accordingly, the main difference from known small container 10 lies in the configuration and manufacture of base 300.

On its top, tank 200 has a cleaning opening 203 which is closed by a locking lid 202. Over the circumference of the cleaning opening, the locking lid 202 is screwed by securing screws 204 against the tank 200, so that a seal, not depicted further, is clamped between locking lid 202 and tank 200. Understandably, alternative locking mechanisms for lid 202 are also conceivable, such as a bayonet lock.

Small container 100 can be stacked. For this purpose, on top a stacking ring 206 of tank 200 is attached onto tank 200 by support strips 208. At the bottom, small container 100 has the base 300. Laterally, distributed evenly about the circumference on base 300, four feet 302 are attached. The feet 302 are placed at intervals to each other by means of flat bars 304 and stacking insertion slots 306 so that from without they radially adjoin the stacking ring 206 of a small container 100 stacked beneath it. Accordingly, in the axial direction, an upper small container 100 stands with its flat bars 304 and stacking insertion slots 306 on the small container 100 stacked beneath it or on its stacking ring 206.

A nearly straight circular-cylindrical wall 205 of tank 200 terminates below in a transition 210 to base 300. Base 300 reaches the lowest point of tank 200 with a drainage opening 60. Draining opening 60 is closed by a shutoff valve 62. For operation, a shutoff cock 66 is provided in the embodiment example. Understandably, other locking mechanisms not depicted here can be provided for locking drainage opening 60.

Figure 2:
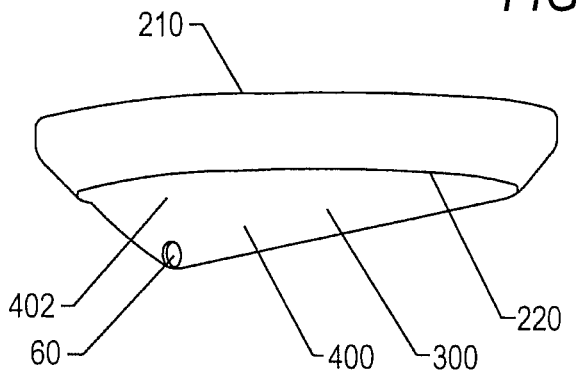
FIG. 2 is a perspective side view of the base of the small container shown in FIG. 1.

FIG. 2 shows in perspective base 300 without the feet 302 and without shutoff valve 62. An encircling curvature 220 is shown in the FIG. 2 depiction as a visible edge.

Since the base 300 of the depicted embodiment example is manufactured as a single piece, at this location no welded seam or the like is provided. In the area of curvature 220, there is a transition from a symmetrical section to an eccentric section that also can generally be configured without curvature 220.

Figure 3:
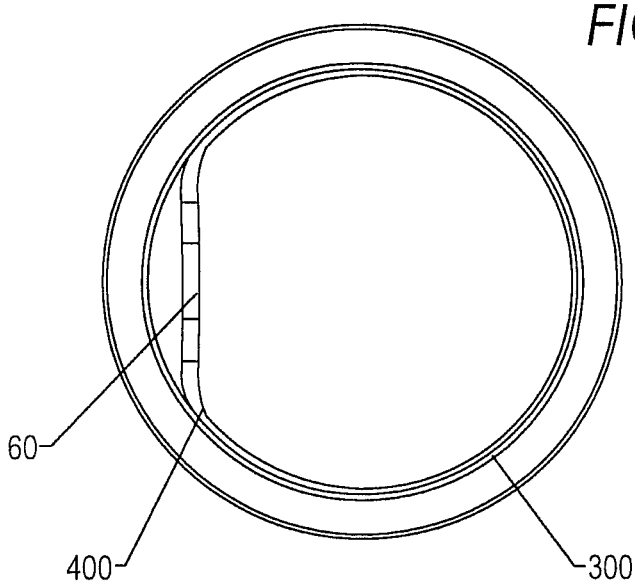
FIG. 3 is a bottom view of the base of the small container shown in FIG. 2.
Figure 4:
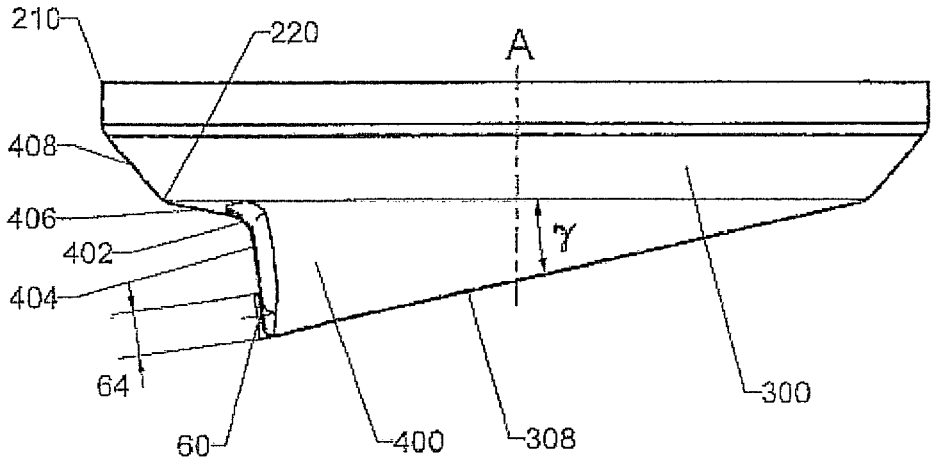
FIG. 4 is a first side view of the base of the small container shown in FIG. 2.
Figure 5:
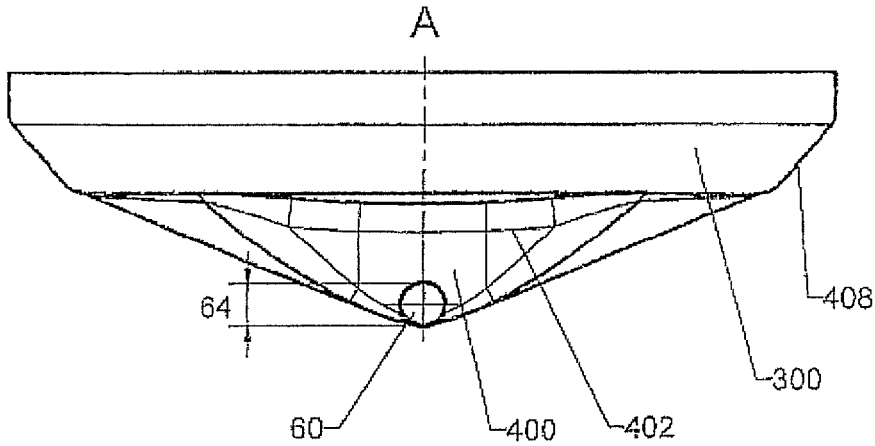
FIG. 5 is a second side view of the base of the small container shown in FIG. 4 after being turned by 90° about the central axis.

FIGS. 3 to 5 show various views of base 300. FIGS. 4 and 5 show side views of base 300, turned by 90° to each other about an axis A. At the bottom, the molded-on discharge hopper 400 is shown.

The base 300 is manufactured from material capable of being deep-drawn. The deep-drawn base 300 is deep-drawn in a wedge shape in the symmetrical section. The discharge hopper 400 molded on below it in the eccentric section is also deep-drawn toward drainage opening 60 having a diameter 64 with a progression of the resulting slope 308 that is as favorable as possible for flowing in the side view of the embodiment example depicted in FIG. 4, the slant 308 is formed nearly over the entire width of tank 200 with a sloping angle .gamma. of about 12.degree. This permits the foodstuff to be fully, reliably drained from tank 200.

According to FIG. 4, the discharge hopper 400 exhibits the drainage opening 60 having a diameter 64 in a radial direction toward one side of small container 100. Above drainage opening 60 is a steep area 404. Above that a hollow wedge 402 forms a transition area to a slightly descending area 406 of base 300. In other respects, base 300 as per FIG. 5 is configured to be wedge-shaped toward drainage opening 50, which determines the geometry of the side walls of discharge hopper 400. Lastly, in an upper area 408 there is a transition to the cylindrical walls 205 of tank 200, which adjoins a transition 210 to base 300.

In the claims, means or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a wooden part, in the environment of fastening wooden parts, a nail, a screw, and a bolt may be readily understood by those skilled in the art as equivalent structures.

Having described at least one of the preferred embodiments of the present invention with reference to the accompanying drawings, it is to be understood that the invention is not limited to those precise embodiments, and that various changes, modifications, and adaptations may be effected therein by one skilled in the art without departing from the scope or spirit of the invention as defined in the appended claims.

What is claimed is:

1. A container for liquid and/or pasty materials, said container comprising a cylindrical tank and a base configured in a wedge shape with a transition from a symmetrical section to an eccentric section, said base having a discharge hopper molded on said base in said eccentric section, and wherein said base is produced in one piece with said discharge hopper, wherein said discharge hopper has a drainage opening with a progression of a resulting slope with a sloping angle in the range of about ten to fourteen degrees (10-14°).

2. The container of claim 1, wherein said discharge hopper is shaped jointly with said base by means of a cupping procedure in said base.

3. The container of claim 1, wherein an upper area of said base is molded with a first stroke of a cupping procedure and said drainage hopper as an eccentric drainage cup is molded with a second stroke of said cupping procedure in said base.

4. The container of claim 1, wherein said base is manufactured from material capable of being deep-drawn.

5. The container of claim 1, wherein a slope of said discharge hopper extends substantially across the width of said base.

6. The container of claim 1, wherein a slope angle of said discharge hopper is about 12 degrees (12°).

7. The container of claim 1, a height of said container falling within the range of four inches (4") and forty-eight inches (48").

8. The container of claim 1, wherein said container further comprises a plurality of support strips mounted on a top portion of said container, said plurality of support strips are for supporting a stacking ring, said stacking ring is for allowing a second container to be stacked thereupon.

9. The container of claim 1, wherein said drainage opening is configured in a radial direction towards one side of said container, above which said drainage opening has a steep area, about which a low wedge forms a transition area to a descending area of said base.

10. A method for manufacturing a container, said container for containing a liquid and/or a pasty material and said container having a cylindrical tank and a base, with said base having a discharge hopper, said method comprising the steps of:

(a) producing said base as a wedge shape with a transition from a symmetrical section to an eccentric section, said base configured in one piece with said discharge hopper;

(b) shaping said discharge hopper with said base by means of a cupping procedure in said base; and (c) molding an upper area of said base with a first stroke of said cupping procedure and said drainage hopper as an eccentric drainage cup with a second stroke of said cupping procedure in said base;

wherein said discharge hopper has a drainage opening with a progression of a resulting slope with a sloping angle in the range of about ten to fourteen degrees (10-14°).

11. A container for liquid and/or pasty materials, said container not exceeding forty-eight inches (48") in height, said container comprising:

(a) a cylindrical tank;

(b) a cleaning portal mounted in the top-most portion of said cylindrical tank, said portal capable of being closed with a screwable cover;

(c) a base configured with a wedge shape with a transition from a symmetrical section to an eccentric section, said base further comprising a discharge hopper;

(d) a stacking support assembly mounted on an upper portion of said container; and (e) a stacking acceptance assembly mounted on a lower portion of said container;

wherein said base is produced in one piece with said discharge hopper, and wherein said discharge hopper has a drainage opening with a progression of a resulting slope with a sloping angle of about ten to fourteen degrees (10-14°).

12. The container of claim 11, wherein said discharge hopper is shaped jointly with said base by means of a cupping procedure in said base.

13. The container of claim 11, wherein an upper area of said base is molded with a first stroke of a cupping procedure and said drainage hopper as an eccentric drainage cup is molded with a second stroke of said cupping procedure in said base.

14. The container of claim 11, wherein said base is manufactured from material capable of being deep-drawn.

15. The container of claim 11, wherein a slope of said discharge hopper extends substantially across the width of said base.

16. The container of claim 11, wherein a slope angle of said discharge hopper is about twelve degrees (12°).

17. The container of claim 11, wherein said stacking support assembly further comprises a plurality of support strips mounted on said upper portion of said container, said plurality of support strips are for supporting a stacking ring, said stacking ring is for allowing a second container to be stacked thereupon.

* * * * *